US010151162B2

(12) United States Patent
Getzlaf et al.

(10) Patent No.: US 10,151,162 B2
(45) Date of Patent: Dec. 11, 2018

(54) HYDRAULIC LOCATOR

(71) Applicant: NCS MULTISTAGE INC., Calgary (CA)

(72) Inventors: Don Getzlaf, Calgary (CA); John Edward Ravensbergen, Calgary (CA)

(73) Assignee: NCS Multistage Inc., Calgary (CA)

( * ) Notice: Subject to any disclaimer, the term of this patent is extended or adjusted under 35 U.S.C. 154(b) by 330 days.

(21) Appl. No.: 14/867,726

(22) Filed: Sep. 28, 2015

(65) Prior Publication Data

US 2016/0090803 A1 Mar. 31, 2016

Related U.S. Application Data

(60) Provisional application No. 62/056,043, filed on Sep. 26, 2014.

(51) Int. Cl.

| | |
|---|---|
| ***E21B 23/04*** | (2006.01) |
| ***E21B 23/02*** | (2006.01) |
| ***E21B 47/09*** | (2012.01) |

(52) U.S. Cl.
CPC ..... *E21B 23/04* (2013.01); *E21B 23/02* (2013.01); *E21B 47/09* (2013.01)

(58) Field of Classification Search
CPC ..... E21B 17/104; E21B 17/1021; E21B 17/1078; E21B 23/01; E21B 23/02;
(Continued)

(56) References Cited

U.S. PATENT DOCUMENTS 3,080,924 A * 3/1963 Baker ..... E21B 23/04 166/212
3,130,788 A * 4/1964 Cochran ..... E21B 23/02 166/217

(Continued)

FOREIGN PATENT DOCUMENTS

| | | |
|---|---|---|
| CA | 2906468 A1 | 3/2016 |
| EP | 0810348 A2 | 12/1997 |
| GB | 2439399 A | 12/2007 |

OTHER PUBLICATIONS

Allen, D. R., Collar and radioactive bullet logging for subsidence monitoring, 1969, SPWLA 10th Annual Logging Symposium, May 25-28, Houston, Texas, Society of Petrophysicists and Well-Log Analysts.

(Continued)

*Primary Examiner* — Jennifer H Gay
(74) *Attorney, Agent, or Firm* — Ridout & Maybee LLP

(57) ABSTRACT

There is provided a locator configured for coupling to a workstring for locating a wellbore feature, The locator includes a protrusible member, a chamber, a hydraulic fluid supplying passage, and a hydraulic fluid supply source. The protrusible member is moveable, relative to the workstring, and biased for disposition, relative to the workstring, in an extended position. In the extended position, the protrusible member is engageable with the wellbore feature. The first chamber is disposed in fluid pressure communication with the protrusible member, and has a volume configured to change correspondingly with a change in position of the protrusible member such that expansion of the first chamber corresponds with an extension of the protrusible member and such that contraction of the first chamber corresponds with a retraction of the protrusible member. The hydraulic fluid supply source is fluidly coupled to the first chamber via the hydraulic fluid supplying passage. The hydraulic fluid (Continued)

supply source is configured to supply hydraulic fluid to the first chamber in response to an expansion in volume of the first chamber that is effected by the extension of the protrusible member.

23 Claims, 4 Drawing Sheets

(58) Field of Classification Search
CPC ..... E21B 23/04; E21B 33/1285; E21B 33/12955; E21B 47/09
See application file for complete search history.

(56) References Cited

U.S. PATENT DOCUMENTS

| | | | | |
|---|---|---|---|---|
| 3,638,723 | A | 2/1972 | Carroll | |
| 4,284,154 | A * | 8/1981 | England | E21B 17/1014 175/325.3 |
| 5,366,019 | A | 11/1994 | Brooks | |
| 5,687,795 | A * | 11/1997 | Patel | E21B 33/1291 166/120 |
| 6,827,148 | B2 | 12/2004 | Shaw et al. | |
| 7,284,606 | B2 | 10/2007 | Coronado | |
| 7,284,608 | B2 | 10/2007 | Reddy et al. | |
| 8,074,713 | B2 | 12/2011 | Ramos et al. | |
| 8,225,869 | B2 | 7/2012 | Beard et al. | |
| 8,267,172 | B2 | 9/2012 | Surjaatmadja et al. | |
| 8,312,925 | B2 | 11/2012 | Trummer et al. | |
| 8,607,860 | B2 | 12/2013 | Avant et al. | |
| 8,794,331 | B2 | 8/2014 | Getzlaf et al. | |
| 9,217,316 | B2 * | 12/2015 | Ehtesham | E21B 47/09 |
| 2004/0149452 | A1 | 8/2004 | Pendleton | |
| 2006/0081380 | A1 | 4/2006 | Hoffman et al. | |
| 2006/0225878 | A1 | 10/2006 | Coronado | |
| 2009/0078413 | A1 | 3/2009 | Tubel et al. | |
| 2012/0279709 | A1 | 11/2012 | Bain et al. | |
| 2013/0161027 | A1 | 6/2013 | Inglis et al. | |
| 2013/0168099 | A1 | 7/2013 | Themig | |
| 2013/0333883 | A1 | 12/2013 | Ehtesham et al. | |
| 2015/0075788 | A1 | 3/2015 | O'Brien et al. | |
| 2015/0075815 | A1 | 3/2015 | O'Brien et al. | |
| 2015/0152725 | A1 * | 6/2015 | Thomas | E21B 47/09 166/255.1 |
| 2016/0047189 | A1 * | 2/2016 | MacLeod | E21B 23/06 166/377 |
| 2016/0090803 | A1 * | 3/2016 | Getzlaf | E21B 23/02 166/382 |

OTHER PUBLICATIONS

General Electric Company, Casting Collar Locators (CCL)—Wireline Systems| GE Energy, http://www.ge-energy.com/products_and_services/products/wireline_systems/casing_collar_locator.jsp, retrieved Aug. 21, 2014.

Connell et al., High-Pressure/High-Temperature Coiled Tubing Casing Collar Locator Provides Accurate Depth Control for Single-Trip Perforating, 2000, SPE/ICoTA Coiled Tubing Roundtable, Apr. 5-6, Houston, Texas, Society of Petroleum Engineers.

Caldwell et al. Plug locator system mitigates cement plug displacement risks, Mar. 18, 2013, http://www.drillingcontractor.org/plug-locator-system-mitigates-cement-plug-displacement-risks-21240, retrieved on May 27, 2016.

* cited by examiner

12
DETAIL "A"
30
32
34
36
10
14
16
22
26
40

104
12
18
14
16
30
34
DETAIL "C"

10
40
16
14
18
34

12
12A

DETAIL "D"
38
30
16
14
18
22

34
32
36
30
38
30
26
40
22
23
16
14
18

HYDRAULIC LOCATOR

FIELD

The present disclosure relates to locators for effecting positioning of tools within a wellbore.

BACKGROUND

It is often desirable to position a tool within a wellbore in order to perform a wellbore operation, such as perforating a casing, or sliding a sleeve for opening and closing a port in order to effect hydraulic fracturing and, subsequently, to receive hydrocarbons from a reservoir.

Contemporary wells often extend over significant distances and may be characterized by significant deviation. In order for a locator to be positioned at or near the extremities of such wells, the locator is configured so as not to offer significant resistance while it is being deployed downhole. However, with a conventional locator, in minimizing its frictional resistance, the reliability of a locator in locating a wellbore feature, and enabling proper positioning of a tool for a downhole operation, suffers. This is because successful locating is often indicated by sensed resistance to overpull applied to the workstring, and there is greater risk that overpull, in circumstances where the locator is configured to offer minimal resistance while travelling though the well, may be confused with other forces that are merely dislodging the workstring from another form of interference within the wellbore.

SUMMARY

In one aspect, there is provided a locator configured for coupling to a workstring for locating a wellbore feature, The locator includes a protrusible member, a chamber, a hydraulic fluid supplying passage, and a hydraulic fluid supply source. The protrusible member is moveable, relative to the workstring, and biased for disposition, relative to the workstring, in an extended position. In the extended position, the protrusible member is engageable with the wellbore feature. The first chamber is disposed in fluid pressure communication with the protrusible member, and has a volume configured to change correspondingly with a change in position of the protrusible member such that expansion of the first chamber corresponds with an extension of the protrusible member and such that contraction of the first chamber corresponds with a retraction of the protrusible member. The hydraulic fluid supply source is fluidly coupled to the first chamber via the hydraulic fluid supplying passage. The hydraulic fluid supply source is configured to supply hydraulic fluid to the first chamber in response to an expansion in volume of the first chamber that is effected by the extension of the protrusible member.

In another aspect, there is provided a method of locating a wellbore feature. The method includes biasing a protrusible member into engagement with the wellbore feature, such that a first chamber, containing hydraulic fluid, and with which the protrusible member is disposed in fluid pressure communication, becomes expanded. After the biasing, additional hydraulic fluid is supplied to the expanded first chamber.

BRIEF DESCRIPTION OF DRAWINGS

The preferred embodiments will now be described with the following accompanying drawings, in which.

DETAILED DESCRIPTION

Referring to FIGS. 1 to 6, the present disclosure relates to a locator 10 for locating a wellbore feature 100. The locator 10 is capable of determining positions within a wellbore and may also be used for identifying downhole structures as reference points for other downhole operations.

The wellbore feature 100 being located may include a collar of a tubular, pipe, or casing disposed within a wellbore, including a collar of a production tubing or a casing string. The locator may also be used for locating a groove 102 (such as a "locate profile") defined by a casing collar, or defined within wellbore string, such as a casing 104 or other tubular. In some embodiments, for example, the groove 102 includes angled edges to facilitate displacement of the locator (and, more specifically, a protrusible member—see below) from the groove.

In some embodiments, for example, the locator 10 is useful for identifying a position within the wellbore such that a perforator, valve, packer, shifting device (for shifting a valve, such as a sliding sleeve) or other tool can be disposed in close proximity to a producing formation.

Figures 1, 2:
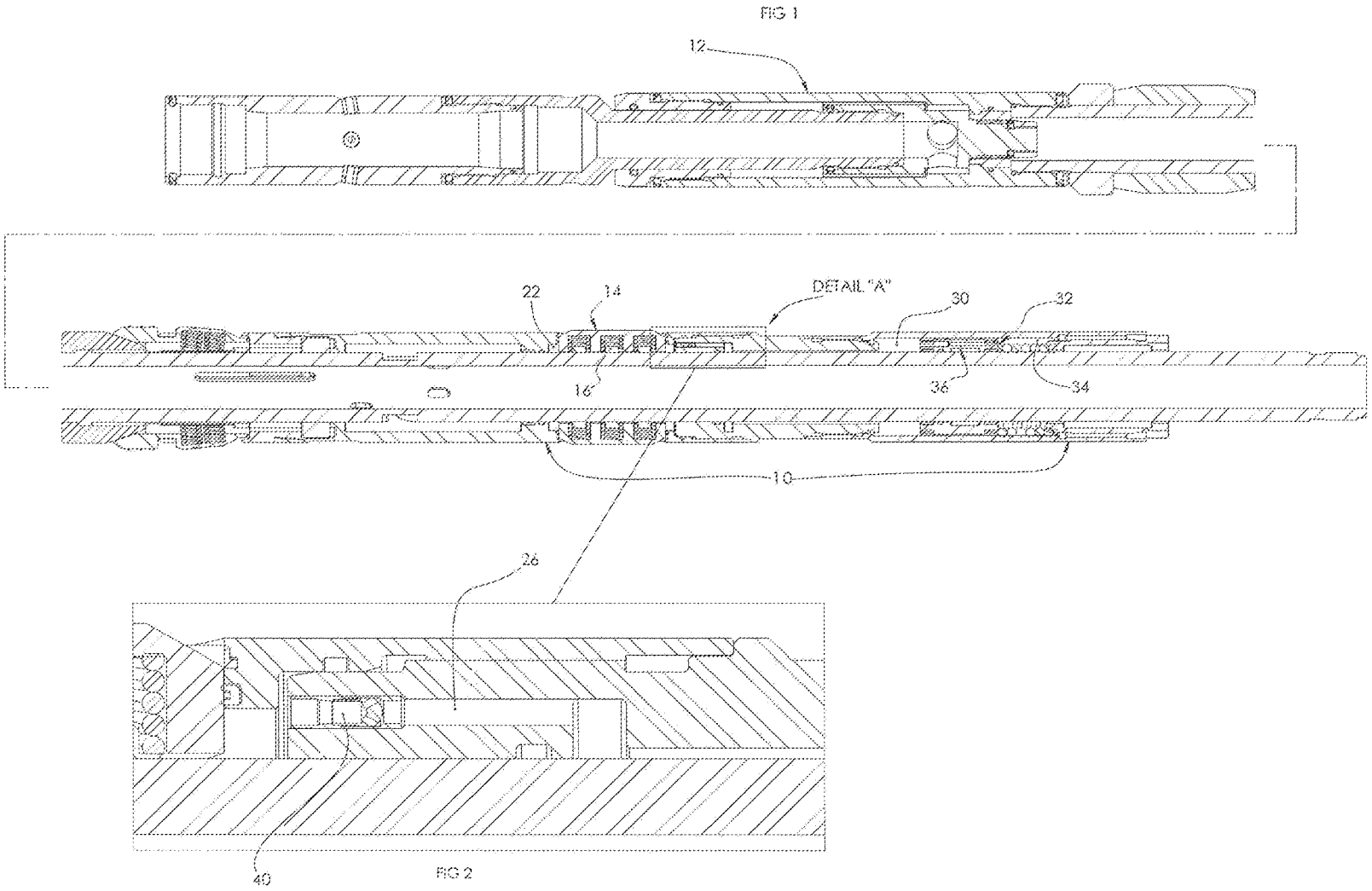
FIG. 1 is a sectional elevation view of a bottom hold assembly ("BHA") including the locator of the present disclosure.
FIG. 2 is an enlarged view of Detail "A" in FIG. 1, including illustration of the locator.

Referring to FIG. 1, the locator 10 may be incorporated within a bottom hole assembly 12 (BHA) containing additional tools (such as those described above), such as by a threaded connection. This may allow multiple operations to be completed in a single run, thereby producing significant time and cost savings.

The locator 10 is configured for deployment downhole into a wellbore using any suitable delivery component which is hereinafter termed a "workstring". In this respect, the locator is configured for coupling to a workstring. Suitable workstrings include tubing string, wireline, cable, or other suitable suspension or carriage systems. Suitable tubing strings include jointed pipe, concentric tubing, or coiled tubing.

The locator 10 includes an engagement feature 8. The engagement feature 8 is configured for releasable engagement from the wellbore feature 100 such that application of a predetermined force to the engagement feature 8 effects its disengagement from the wellbore feature 100. In some embodiments, for example, the engagement of the engagement feature 8 with the wellbore feature 100 may be observed by an operator at the surface as an increase in force required to displace (for example, a pull force or a push force) the locator 10 within the wellbore. One method of sensing the engagement is with a weight indicator which registers a decrease in weight when the engagement feature 8 becomes engaged to the wellbore feature 100. This information may be communicated to the surface by transmission through a wireline.

Figure 9:
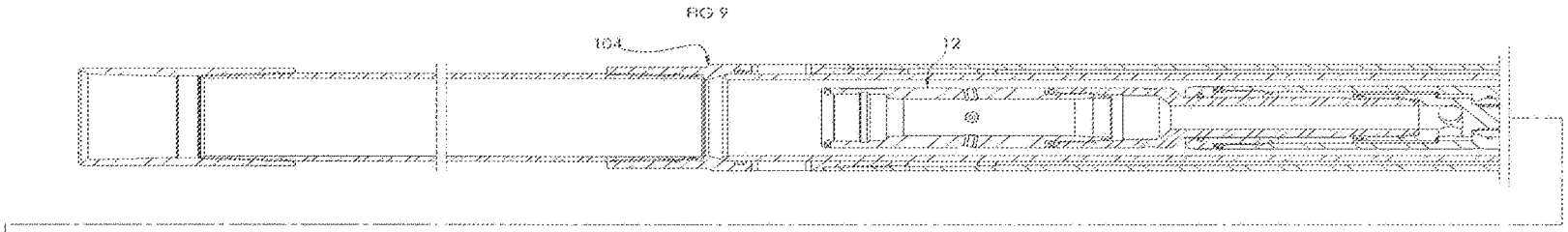
FIG. 9 is a sectional elevation view of the BHA illustrated in FIG. 1, with its locator being disposed in the "locating" state.
Figure 10:
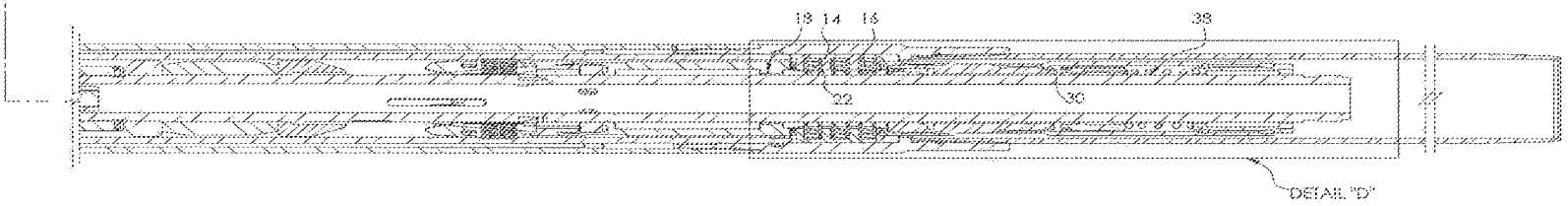
FIG. 10 is an enlarged view of Detail "D" in FIG. 9, including illustration of the locator.
Figure 10:
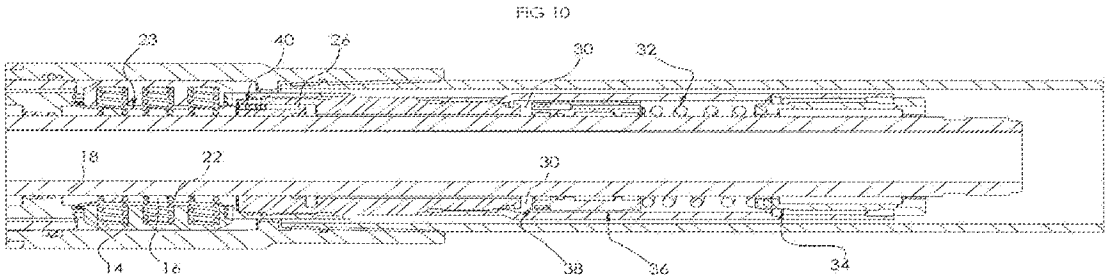

In some embodiments, for example, the engagement feature 8 includes a protrusible member 14. The protrusible member 14 may be a lug, a pad, a block, or any other object, device or assembly which is capable of displacement, relative to the workstring, so as to engage the wellbore feature. While the locator 10 is coupled to the workstring and disposed within a wellbore including the wellbore feature, the protrusible member 14 is displaceable, relative to the workstring, and biased for disposition, relative to the workstring, in an extended position (see FIGS. 9 and 10). In the extended position, the protrusible member 14 is engageable with the wellbore feature 100. In some embodiments, for example, where the wellbore feature 100 includes a recess, such as a groove 102, the engagement of the protrusible member 14 to the wellbore feature is effected by disposition of the protrusible 14 member within the groove 102.

In some embodiments, for example, the biasing of the protrusible member 14 is effected by a first resilient member 16, such as a spring. In this respect, in such embodiments, for example, the locator 10 includes the first resilient member 16. The first resilient member 16 is retained within a retainer 18. In some of these embodiments, for example, the first resilient member 16 is co-located with the space defined by a first chamber 22 (see below).

In those embodiments where the wellbore feature 100 includes a groove 102 (such as, for example, a locate profile), the biasing of the protrusible member 14 includes biasing of the protrusible member 14 for disposition within the groove 102 while the protrusible member 14 is positioned in alignment with the groove.

The locator 10 includes a body 20, and the body 20 includes a first chamber 22, a hydraulic fluid supply source 24, a hydraulic fluid supplying passage 26, and a hydraulic fluid discharging passage.

The first chamber 22 is disposed in fluid pressure communication with the protrusible member 14. In this respect, during some stages of operation of the locator 10, sufficient fluid may be present within the first chamber 22 to provide resistance to retraction of the protrusible member 14 from an extended position. The volume defined by the first chamber 22 is configured to change correspondingly with a change in position of the protrusible member 14. As the protrusible member 14 is being extended, relative to the workstring (and the body 20), by the biasing force, the volume defined by the first chamber 22 is being correspondingly expanded. While the protrusible member 14 is being retracted, relative to the workstring (and the body 20), the first chamber 22 is, correspondingly, contracted.

As used herein, "refracted" may refer to any position in which the protrusible member 14 has moved from an extended position, and includes the position wherein the protrusible member 14 is no longer in engagement with the wellbore feature 100 (for example, displaced from a groove 102, such as a locate profile), but it is understood that the protrusible member 14 has not necessarily become displaced from engagement with the wellbore feature 100 in order to have been retracted.

In some embodiments, for example, at least a portion of the first chamber 22 is defined by the protrusible member 14. In some of these embodiments, for example, the protrusible member 14 defines a wall portion 23 of the first chamber 22 (see FIG. 10).

The hydraulic fluid supply source 24 is fluidly coupled to the first chamber 22 via the hydraulic fluid discharging passage 26. The hydraulic fluid supply source 24 is configured to supply hydraulic fluid (such as, for example, a hydraulic oil) to the first chamber 22 in response to an expansion in volume of the first chamber 22 that is effected by the extension of the protrusible member 14. In some operational implementations, for example, the supplying of the hydraulic fluid, in response to the expansion in volume of the first chamber 22, is such that the expanded volume becomes filled with the hydraulic fluid such that the hydraulic fluid within the first chamber 22 effects resistance to retraction of the extended protrusible member 14.

In some embodiments, for example, the hydraulic fluid includes an incompressible fluid, such as a liquid. In some embodiments, for example, the hydraulic fluid includes hydraulic fluid sold under the trademark SHELL TELLUS™ 32.

In some embodiments, for example, the hydraulic fluid supply source 24 includes a second chamber 30. The second chamber 30 is fluidly coupled to the first chamber 22 via the hydraulic fluid supplying passage 26. The hydraulic fluid supplying passage 26 extends between the first and second chambers 22, 30 and is configured for conducting hydraulic fluid from the second chamber 30 to the first chamber 22. The second chamber 30 is biased for disposition to a volume-contracted position. In this respect, when fluid pressure within the first chamber 22 becomes reduced owing to expansion of the first chamber 22, effected by the extension of the protrusible member 14, the biasing of the second chamber 30 results in contraction of the volume defined by the second chamber 30, leading to transfer of hydraulic fluid from the second chamber to the first chamber 22, until hydraulic fluid fills the space defined by the expanded first chamber 22 such that fluid pressure equalizes between the first and second chambers 22, 30. As a corollary, the fluid pressure within the expanded first chamber 22 functions to resist retraction of the extended protrusible member 14. In this respect, in some embodiments, for example, the biasing of the second chamber 30 co-operates with displacement of the protrusible member 14 to the extended position for effecting supplying of hydraulic fluid from the second chamber 30 to the first chamber 22 in response to movement of the protrusible member 14 to the extended position.

In some embodiments, for example, the biasing of the second chamber 30 to the volume-contracted position, is effected by a second resilient member 32, such as a spring. In this respect, in such embodiments, for example, the locator includes the second resilient member 32. The second resilient member 32 is retained within a second retainer 34.

In some embodiments, for example, the locator 10 further includes a displaceable piston 36. The piston 36 is displaceable relative to chamber 30 to effect a change in volume of the chamber 30. The piston 36 defines at least a portion of the second chamber 30, such as a wall portion 38 of the chamber 30. The second resilient member 32 is connected to the piston 36 such that the piston 36 is biased to effect contraction of the second chamber 22.

In those embodiments where the hydraulic fluid supply source 24 includes a second chamber 30, in some of these embodiments, for example, a one-way valve 40 (such as, for example, a check valve) is disposed within the hydraulic fluid supplying passage 26. The one-way valve 40 is configured for preventing, or substantially preventing, conducting of hydraulic fluid from the first chamber 22 to the second chamber 30. Conversely, conducting of hydraulic fluid, from the second chamber 30 to the first chamber 22 is permitted by the one-way valve. As is explained further below, the preventing, or substantially preventing, of the conducting of hydraulic fluid from the first chamber 22 to the second chamber 30 contributes to the delaying of depressurization of the first chamber 22, and, concomitantly, the delaying of displacement of the protrusible member 14 from the engagement with the wellbore feature 100.

The hydraulic fluid discharging passage extends distally from the first chamber 22. The hydraulic fluid discharging passage is provided for at least discharging hydraulic fluid from the first chamber 22. The hydraulic fluid discharging passage is configured to sufficiently interfere with the discharging such that hydraulic fluid, disposed within the first chamber 22 and resisting displacement of the protrusible member 14 from the extended position, continues to resist the displacement while the discharging is being effected (for at least a finite time interval). In some embodiments, for example, the interference to the discharging by the hydraulic fluid discharging passage is such that, while a force is being applied to the workstring and urging retraction of the protrusible member 14 from the extended position, displacement of the protrusible member 14 from the extended position is delayed by a time interval, measured from the commencement of the urging, and corresponding to an indication that the protrusible member 14 is engaged with the wellbore feature 100 and is being urged for displacement from its engagement with the wellbore feature 100. In some embodiments, for example, the time interval is at least 20 seconds, such as, for example, at least 30 seconds.

In some embodiments, for example, the hydraulic fluid discharging passage includes a flow restrictor.

In some embodiments, for example, the hydraulic fluid discharging passage extends to the second chamber 30 such that the first chamber 22 is also disposed in fluid communication with the second chamber 30 via the hydraulic fluid discharging passage. In this respect, the hydraulic fluid, that is being discharged via the hydraulic fluid discharging passage, is conserved within the locator 10 and available for re-use.

In those embodiments where the wellbore feature 100 includes a groove 102, in some of these embodiments, for example, the hydraulic fluid supplying passage 26 is configured to supply hydraulic fluid from the second chamber 30 to the first chamber 22 at a sufficient rate such that, while the protrusible member 14 is being displaced within the groove 102, sufficient hydraulic fluid is present within the first chamber 22 for resisting displacement of the protrusible member 14 from the extended position to the retracted position in response to urging by the workstring, so long as the protrusible member 14 is being moved within the groove 102 at a speed that is less than, or equal to, a maximum predetermined speed. In some embodiments, for example, the maximum predetermined speed is at least 10 meters per minute. In some of these embodiments, for example, the maximum predetermined speed is at least 20 meters per minute.

Travel above the maximum predetermined speed may result in the failure to locate the locator 10 versus the groove 102. In this respect, in some operational implementations, for example, while the protrusible member 14 is being displaced within the groove 102 at a speed that is above the maximum predetermined speed, the rate of supplying of hydraulic fluid from the second chamber 30 to the first chamber 22, for which the hydraulic fluid supplying passage 26 is configured, is insufficient to create conditions within the first chamber 22 whereby displacement of the protrusible member 14 from the extended position to the retracted position by the workstring is resisted by the hydraulic fluid within the first chamber 22. Also, in this respect, in some operational implementations, it is desirable to have the locator 10 travel past the groove 102, without locating within the groove 102, and, to do so, the workstring (and, thus, the locator) should be moving above the maximum predetermined speed, in order to avoid the locating of the locator 10.

In some embodiments, for example, the body 20 further includes a relief fluid passage. The relief fluid passage extends from the first chamber 22 and is configured to discharge fluid from the first chamber 22 when the fluid pressure within the first chamber 22 exceeds a predetermined maximum pressure. In this respect, a relief valve is disposed within the relief fluid passage and is actuated to open when the fluid pressure within the first chamber 22 exceeds a predetermined maximum pressure. In some embodiments, for example, the relief fluid passage extends to the second chamber 30.

Figure 3:
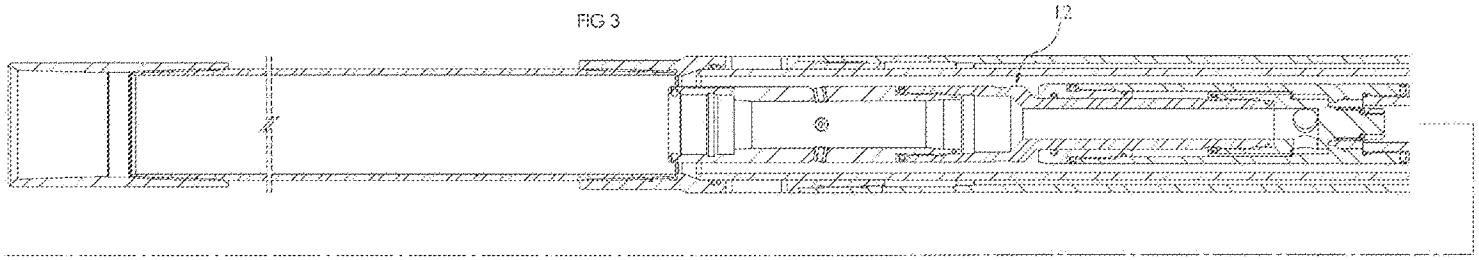
FIG. 3 is a sectional elevation view of the BHA illustrated in FIG. 1, having been deployed within a wellbore tubular, and disposed in a "run-in-hole" mode.
Figure 6:
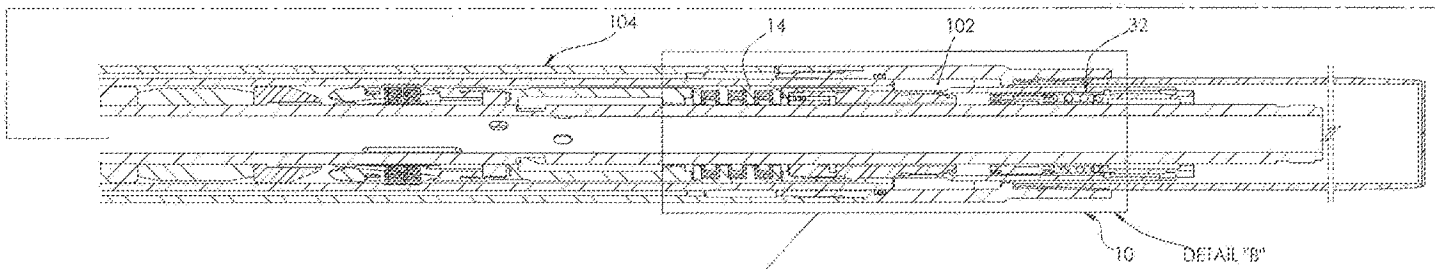
FIG. 6 is a sectional elevation view of the BHA illustrated in FIG. 1, having been deployed within a wellbore tubular, taken along lines D-D in FIG. 4.
Figure 6:
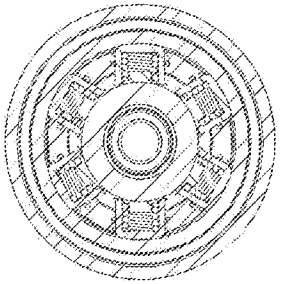
Figure 5:
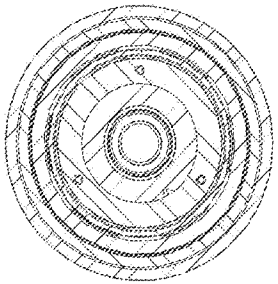
FIG. 5 is a sectional elevation view of the BHA illustrated in FIG. 1, having been deployed within a wellbore tubular, and taken along lines C-C in FIG. 4.
Figure 4:
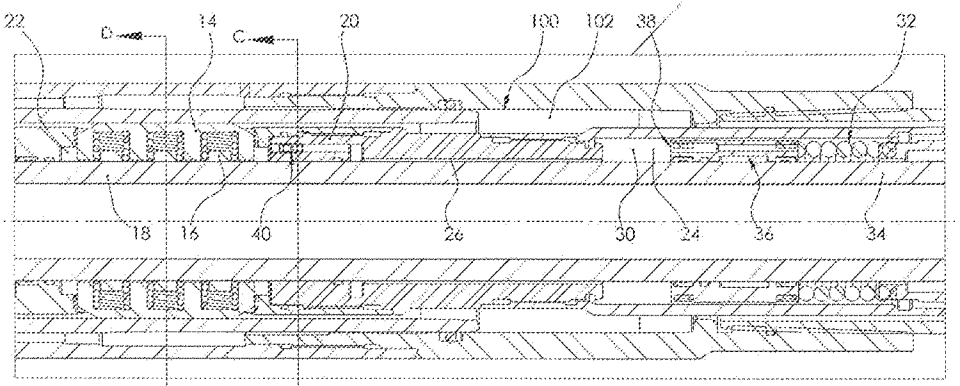
FIG. 4 is an enlarged view of Detail "B" in FIG. 3, including illustration of the locator.
Figure 7:
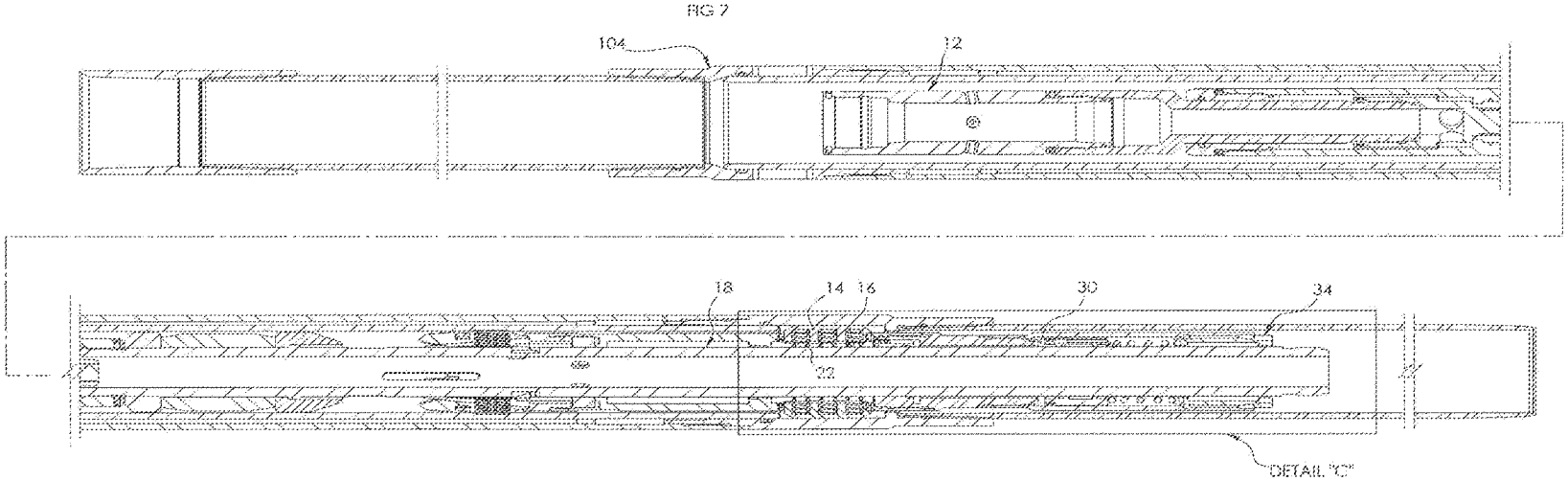
FIG. 7 is a sectional elevation view of the BHA illustrated in FIG. 1, having been deployed within a wellbore tubular, and having had the locator traverse a locate profile defined within the wellbore tubular; reverse direction, and move uphole such that the locator is disposed immediately prior to its "locating" state.
Figure 8:
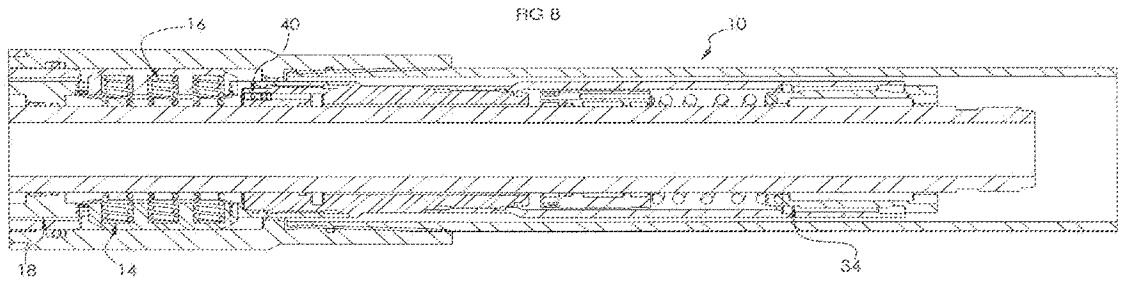
FIG. 8 is an enlarged view of Detail "C" in FIG. 7, including illustration of the locator.

Referring to FIGS. 3 and 4, in some operational implementations, for example, the workstring, including the locator 10, is lowered into the wellbore through a wellbore tubular, such as a casing string. As the workstring is lowered into the wellbore, the protrusible member 14 is urged inwardly while traversing the casing string. The workstring is lowered at a descent rate such that inadvertent locating of the locator 10 is avoided (i.e. at above a maximum predetermined speed). The workstring is lowered such that the locator becomes positioned downhole relative to an estimated location of a locate profile 102. Referring to FIGS. 7 and 8, once the locator 10 becomes deployed in this position, the workstring is pulled upwardly so that the locator 10 begins travelling in an uphole direction, but at an ascent rate that is below the maximum predetermined speed. When the protrusible member 14 of the locator 10 becomes positioned in alignment with the locate profile 102, the biasing force causes extension of the protrusible member 14 into the locate profile 102 such that the protrusible member 14 becomes disposed within the locate profile 102, and, as a corollary, the first chamber 22 becomes expanded. In parallel, hydraulic fluid is supplied from the second chamber 30 to the first chamber 22 such that the contents of the expanded first chamber 22 become filled with hydraulic fluid, thereby providing resistance to displacement of the protrusible member 14 from the locate profile 102 (see FIGS. 9 and 10). Continued application of a pulling force to the workstring does not immediately effect displacement of the protrusible member 14. This is because the one-way valve interferes with discharge of the hydraulic fluid from the first chamber 22 to the second chamber 30 via the hydraulic fluid supplying passage 26. Also, the hydraulic fluid discharging passage, although effecting discharging of the hydraulic fluid from the first chamber 22 to the second chamber 30, while the workstring is being pulled uphole and translating forces to such hydraulic fluid via the protrusible member 14, is sufficiently interfering with such fluid flow such that retraction of the protrusible member 14, resulting in displacement from the locate profile 102, is delayed by a time interval, measured from the commencement of the urging of the retraction by the pulling up force on the workstring, and corresponding to an indication that the protrusible member 14 has become located within the locate profile 102 and is now being urged for displacement from the locate profile 102 (but not yet displaced from the locate profile). In some embodiments, for example, the time interval is at least 20 seconds, such as, for example, at least 30 seconds. Eventually, sufficient hydraulic fluid is conducted from the first chamber 22 to the second chamber 30 such that fluid pressure within the first chamber 22 is insufficient to resist displacement of the protrusible member 14 from the locate profile 102, such that the protrusible member 14 becomes displaced from the locate profile 102 by the pulling up forces being applied to the workstring.

In this respect, there is also provided a method of locating a wellbore feature 100. The method includes biasing the protrusible member 14 into engagement with the wellbore feature 100, such that the first chamber 22, containing hydraulic fluid, and with which the protrusible member 14 is disposed in fluid pressure communication, becomes expanded. In response to the expansion of the first chamber 22, additional hydraulic fluid is supplied to the expanded first chamber 22.

In some operational implementations, for example, the supplying is such that sufficient hydraulic fluid is present within the first chamber 22 so as to resist displacement of the protrusible member 14 from the engagement with the wellbore feature 100 in response to a force urging such displacement.

In some operational implementations, for example, the wellbore feature 100 includes a groove 102 (such as a locate profile), and the biasing of the protrusible member 14 into the groove 102 is effected while the protrusible member 14 is in motion and disposed in alignment with the groove 102. In some of these operational implementations, for example, the speed at which the protrusible member 14 is being moved within the groove 102 (such as a locate profile) is sufficiently low such that sufficient time is provided for receiving of additional hydraulic fluid by the first chamber 22, such that sufficient hydraulic fluid is present within the first chamber 22 for resisting displacement of the protrusible member 14 from the groove 102 in response to a force urging such displacement. In some of these operational implementations, for example, the speed at which the protrusible member 14 is being moved within the groove 102 (such as a locate profile) is sufficiently high such that insufficient time is provided for receiving of additional hydraulic fluid by the first chamber 22, such that insufficient hydraulic fluid is present within the first chamber 22 for resisting displacement of the protrusible member 14 from the groove 102 in response to application of a force urging the displacement.

In some operational implementations, for example, the method further includes urging displacement of the protrusible member 14 from the wellbore feature 100.

In some operational implementations, for example, the method further includes, after the protrusible member 14 has become engaged with the wellbore feature 100 in response to the biasing, urging displacement of the protrusible member 14 from the engagement with the wellbore feature 100, and conducting the hydraulic fluid from the first chamber 22 at a sufficiently low rate such that resistance to displacement of the protrusible member 14 from the engagement with the wellbore feature 100 is maintained for a time interval, measured from commencement of the urging, and corresponding to an indication that the protrusible member 14 is being urged for displacement from its engagement with the wellbore feature 100. In some embodiments, for example, the time interval is at least 20 seconds, such as, for example, at least 30 seconds.

In some operational implementations, for example, the supplying of the hydraulic fluid is from a second chamber 30, and wherein the conducting of the hydraulic fluid from the first chamber 22, after the protrusible member 14 has become engaged with the wellbore feature 100 in response to the biasing, is to the second chamber 30.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A locator comprising:

a protrusible member displaceable between a retracted position and an extended position, and biased for disposition in the extended position;

a first chamber, disposed in fluid pressure communication with the protrusible member such that fluid within the first chamber opposes retraction of the protrusible member, wherein the volume of the first chamber is configured to change correspondingly with a change in position of the protrusible member such that expansion of the first chamber corresponds with an extension of the protrusible member and such that contraction of the first chamber corresponds with a retraction of the protrusible member;

a hydraulic fluid supplying passage; and a hydraulic fluid supply source fluidly coupled to the first chamber via the hydraulic fluid supplying passage for supplying hydraulic fluid to the first chamber in response to an expansion in volume of the first chamber that is effected by the extension of the protrusible member.

2. The locator as claimed in claim 1, further comprising:

a hydraulic fluid discharging passage extending from the first chamber for at least discharging hydraulic fluid from the first chamber in response to retraction of the protrusible member.

3. The locator as claimed in claim 2;

wherein the protrusible member, the first chamber, the hydraulic fluid discharging passage, and the hydraulic fluid are co-operatively configured such that, while the protrusible member is disposed in the extended position and is being urged to retract from the extended position, interference to the discharging of the hydraulic fluid from the first chamber is effected such that the retraction is delayed.

4. The locator as claimed in claim 2, further comprising:

a pressure relief valve disposed within the hydraulic fluid discharging passage.

5. The locator as claimed in claim 1;

wherein the supplying the hydraulic fluid, in response to the expansion in volume of the first chamber, is such that the expanded volume becomes filled with the hydraulic fluid such that the hydraulic fluid within the first chamber effects resistance to retraction of the extended protrusible member.

6. The locator as claimed in claim 1;

wherein:

the hydraulic fluid supply source includes a second chamber biased for disposition to a volume-contracted position;

the hydraulic fluid supplying passage extends between the first and second chambers and is configured for conducting hydraulic fluid from the second chamber to the first chamber; and the locator further comprises:

a one-way valve disposed with the hydraulic fluid supplying passage and configured for preventing conducting of hydraulic fluid from the first chamber to the second chamber.

7. The locator as claimed in claim 6;

wherein the biasing of the second chamber co-operates with displacement of the protrusible member to the extended position for effecting supplying of hydraulic fluid from the second chamber to the first chamber in response to displacement of the protrusible member to the extended position.

8. The locator as claimed in claim 1;

wherein the protrusible member, the first chamber, the hydraulic fluid discharging passage, and the hydraulic fluid are co-operatively configured such that, while the protrusible member is disposed in the extended position and is being urged to retract from the extended position, interference to the discharging of the hydraulic fluid from the first chamber is effected such that the retraction is delayed.

9. A wellbore tubular including a locate profile, and a locator for locating a downhole tool relative to the locate profile, wherein the locator comprises:

a protrusible member displaceable between a retracted position and an extended position;

a first chamber, disposed in fluid pressure communication with the protrusible member such that fluid within the first chamber opposes retraction of the protrusible member, wherein the volume of the first chamber is configured to change correspondingly with a change in the position of the protrusible member such that expansion of the first chamber corresponds with an extension of the protrusible member and such that contraction of the first chamber corresponds with a retraction of the protrusible member;

a hydraulic fluid supplying passage; and a hydraulic fluid supply source fluidly coupled to the first chamber via the hydraulic fluid supplying passage for supplying hydraulic fluid to the first chamber in response to an expansion in volume of the first chamber that is effected by the extension of the protrusible member;

wherein the protrusible member, the first chamber, the hydraulic fluid supply passage, the hydraulic fluid supply source, the hydraulic fluid, and the locate profile are co-operatively configured such that: (a) while the protrusible member is being moved within the locate profile at a first speed, sufficient hydraulic fluid is present within the first chamber for resisting retraction of the protrusible member from the extended position, and (b) while the protrusible member is being moved within the locate profile at a second speed that is greater than the first speed, the rate of supplying of hydraulic fluid from the second chamber to the first chamber is insufficient to fill the first chamber with hydraulic fluid for resisting retraction of the protrusible member from the extended position.

10. The wellbore tubular and the locator as claimed in claim 9;

wherein the first speed is at least 10 meters per minute.

11. The wellbore tubular and the locator as claimed in claim 9;

wherein the first speed is at least 20 meters per minute.

12. A method of locating within a locate profile comprising:

extending a protrusible member into engagement with the locate profile, such that a first chamber, containing hydraulic fluid, and with which the protrusible member is disposed in fluid pressure communication such that retraction of the protrusible member is opposed by the hydraulic fluid, becomes expanded;

supplying additional hydraulic fluid to the expanded first chamber; and moving the protrusible member within the locate profile, wherein the speed at which the protrusible member is being moved within the locate profile is such that additional hydraulic fluid is supplied to the first chamber such that retraction of the protrusible member from the locate profile in response to a force urging such displacement is resisted.

13. The method as claimed in claim 12;

wherein the supplying is such that sufficient hydraulic fluid is present within the first chamber so as to resist retraction of the protrusible member in response to a force urging such retraction.

14. The method as claimed in claim 12;

wherein the supplying of the hydraulic fluid is from a second chamber, and the conducting of the hydraulic fluid from the first chamber, after the protrusible member has become engaged to the locate profile, is to the second chamber.

15. A method of interacting with a locate profile within a wellbore, comprising:

extending a protrusible member into engagement with the locate profile, such that a first chamber, containing hydraulic fluid, and with which the protrusible member is disposed in fluid pressure communication such that retraction of the protrusible member is opposed by the hydraulic fluid, becomes expanded;

supplying additional hydraulic fluid to the expanded first chamber; and displacing the protrusible member within the locate profile, wherein the speed at which the protrusible member is being displaced within the locate profile is such that the rate of supplying hydraulic fluid to the first chamber is insufficient to fill the first chamber with hydraulic fluid for resisting retraction of the protrusible member from the locate profile in response to application of a force urging the retraction.

16. The method as claimed in claim 15;

wherein the speed at which the protrusible member is being displaced is greater than 10 meters per minute.

17. The method as claimed in claim 15;

wherein the speed at which the protrusible member is being displaced is greater than 20 meters per minute.

18. A method of locating within a locate profile, comprising:

extending a protrusible member into engagement with the locate profile, such that a first chamber, containing hydraulic fluid, and with which the protrusible member is disposed in fluid pressure communication such that retraction of the protrusible member is opposed by the hydraulic fluid, becomes expanded;

supplying additional hydraulic fluid to the expanded first chamber; and urging retraction of the protrusible member from the locate profile, and conducting the hydraulic fluid from the first chamber at a rate such that resistance to the retraction of the protrusible member from the locate profile is maintained for a time interval indicative of the engagement of the protrusible member with the locate profile.

19. The method as claimed in claim 18;

wherein the time interval is at least 20 seconds.

20. The method as claimed in claim 18;

wherein the time interval is at least 30 seconds.

21. A locator for locating a downhole tool, wherein the locator comprises:

a protrusible member displaceable between a retracted position and an extended position, wherein the extended position is indicative of the locating of the downhole tool;

a first chamber, disposed in fluid pressure communication with the protrusible member such that fluid within the first chamber opposes retraction of the protrusible member, wherein the volume of the first chamber is configured to change correspondingly with a change in the position of the protrusible member such that expansion of the first chamber corresponds with an extension of the protrusible member and such that contraction of the first chamber corresponds with a retraction of the protrusible member;

a hydraulic fluid supplying passage; and a hydraulic fluid supply source fluidly coupled to the first chamber via the hydraulic fluid supplying passage for supplying hydraulic fluid to the first chamber in response to a pressure drop in the first chamber effected by an expansion in volume of the first chamber that is effected by the extension of the protrusible member;

wherein the protrusible member, the first chamber, the hydraulic fluid discharging passage, and the hydraulic fluid are co-operatively configured such that, while the protrusible member is disposed in the extended position and is being urged to retract from the extended position, interference to the discharging of the hydraulic fluid from the first chamber is effected such that the retraction of the protrusible member is impeded for providing an uphole indication of the locating of the downhole tool.

22. The locator as claimed in claim 21;

wherein the uphole indication includes a delay in retraction of the protrusible member by a time interval of at least 20 seconds.

23. The locator as claimed in claim 21;

wherein the uphole indication includes a delay in retraction of the protrusible member by a time interval of at least 30 seconds.

* * * * *